US006664927B2

(12) United States Patent
Eggleston

(10) Patent No.: US 6,664,927 B2
(45) Date of Patent: Dec. 16, 2003

(54) ANTENNA TRANSDUCER ASSEMBLY, AND ASSOCIATED METHOD, FOR A RADIO DEVICE

(75) Inventor: Steve Eggleston, San Diego, CA (US)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/102,462

(22) Filed: Mar. 20, 2002

(65) Prior Publication Data

US 2003/0179141 A1 Sep. 25, 2003

(51) Int. Cl.[7] ..... H01Q 1/24
(52) U.S. Cl. ..... 343/700 MS; 343/754
(58) Field of Search ..... 343/700 MS, 754, 343/770, 702, 846, 848, 876; 340/10.1, 10.3

(56) References Cited

U.S. PATENT DOCUMENTS 4,899,164 A * 2/1990 McGrath ..... 343/754
6,476,769 B1 * 11/2002 Lehtola ..... 343/702
6,531,957 B1 * 3/2003 Nysen ..... 340/10.1

* cited by examiner

*Primary Examiner*—James Clinger
(74) *Attorney, Agent, or Firm*—Milan I. Patel

(57) ABSTRACT

An antenna transducer assembly, and an associated method, for a mobile station, or other radio transducer. The antenna transducer assembly includes first and second antenna transducers disposed upon a substrate. The antenna transducers are elongated transmission lines and are of lengths to facilitate their transducing of radio signals that are generated to be of first and second frequency characteristics. The first antenna transducer includes a distal end part that defines an edge face surface. And, the second antenna transducer includes a distal end part such that a distal end part thereof is positioned in an orthogonal relationship to the edge face surface of the first antenna transducer.

18 Claims, 2 Drawing Sheets

ANTENNA TRANSDUCER ASSEMBLY, AND ASSOCIATED METHOD, FOR A RADIO DEVICE

The present invention relates generally to a manner by which to transduce communication signals at a radio device, such as a mobile station operable in a cellular communication system. More particularly, the present invention relates to an antenna transducer assembly, and an associated method, for a multi-mode, mobile station, or other radio device, capable of operation in at least two separate frequency bands. The assembly is of compact dimensions and exhibits reduced antenna-transducer coupling relative to conventional antenna transducers. Improved gain characteristics of antenna transducer operation is thereby provided.

BACKGROUND OF THE INVENTION

Advancements in communication technologies have permitted the development, and implementation, of many varied types of communication systems. Radio communication systems are exemplary of communication systems whose development and implementation have been permitted as a result of communication-technology advancements.

Similar to other types of communication systems, a radio communication system provides for the communication of data between a sending station and a receiving station by way of a communication channel. The communication channel of a radio communication system is formed of a radio channel, defined upon a radio link formed between the sending and receiving stations. The radio channel defined upon the radio link is characterized, at least in part, by a frequency about which the channel is centered.

A cellular communication system is an exemplary type of radio communication system. Cellular communication systems have been installed throughout significant geographical areas and have achieved significant levels of usage by large numbers of users. In a cellular communication system, telephonic communications are effectuable. Typically, both voice and data can be communicated. Telephonic communications are advantageously effectuated by way of a cellular communication system as communications are effectuable by a user when positioned at almost any location at which a radio link with a network infrastructure part of the communication system can be formed. Improved mobility of communications is thereby possible as communication links are formed upon radio links rather than through wireline connections required to effectuate communications in a conventional wireline communication system.

A radio transceiver, referred to as a mobile station, is utilized by a user to communicate telephonically in a cellular communication system. Mobile stations are regularly constructed to mimic operation of conventional wireline, telephonic stations. That is to say, when a telephonic call is originated at the mobile station, a user of the mobile station generally must enter dialing digits associated with a terminating location at which the call is intended to be terminated. And, when a call is placed to the mobile station, a ringing sound, or other annunciation, is generated to alert the user of the mobile station of the terminating call.

Various cellular communication standards have been promulgated. And, the cellular communication systems that have been implemented are generally operable pursuant to an associated one of such standards. For instance, the network infrastructures of various cellular communication systems are constructed to be operable in conformity with a particular cellular communication standard. Successive generations of cellular communication standards have been promulgated, and communication systems implementing such successive generations of standards have been implemented.

First implementations of cellular communications, generally referred to as first-generation systems, utilize analog communication techniques. The AMPS (Advanced Mobile Phone Service) system defined pursuant to the IS-41 standard promulgated by the EIA/TIA is representative of a first-generation system.

Successor-generation systems that form immediate successors to the first-generation systems are referred to as second-generation systems. Second-generation systems generally utilize digital communication techniques. The GSM (Global System for Mobile communications) cellular communication system and the CDMA (Code-Division, Multiple-Access) system, set forth in the IS-95 standard promulgated by the EIA/TIA are representative of second-generation, cellular communication systems.

And, successor systems to the second-generation systems are referred to as third-generation systems. Third-generation systems generally also utilize digital communication techniques. Third-generation systems further generally provide for multiple rates of data communications.

The geographical areas encompassed by different ones of the cellular communication systems of different, or corresponding, generations sometimes partly, or completely, overlap. And, conversely, sometimes, the geographical area encompassed by one cellular communication system is intermittent. That is to say, continuous coverage over an entire geographical area in which a user of a mobile station might be positioned is not provided. And, therefore, the user of a mobile station might carry the mobile station out of the area encompassed by one cellular communication system and into an area encompassed only by another communication system.

Mobile stations have been constructed to permit their operation in more than one cellular communication system. Mobile stations operable in two different types of communication systems are sometimes referred to as being dual-mode mobile stations. And, more generally, mobile stations operable in more than one communication system are referred to as being multi-mode mobile stations.

Different cellular communication systems are operable at different frequency bands. For instance, some communication systems are operable at frequencies located in the 800 MHz band. And, other systems are operable at other frequencies within a 1.9 GHz frequency band. Circuitry of a multi-mode mobile station operable in such separate communication systems must be capable of operation at the separate frequency bands. Antenna transducers utilized at the separate frequency bands are of different characteristics to facilitate their transducing into, and out of, electromagnetic form signals generated during operation of the respective systems. The antenna transducers are, for instance, of lengths inversely proportional to the frequencies of the signals transduced at such antenna transducers. And, when a mobile station is constructed to be operable at two separate frequency bands, two separate antenna transducers are used.

And recent requirements mandate that the positioning of a mobile station be determinable. Positioning information related to the mobile station is needed by emergency assistance personnel. GPS (Global Positioning System) receivers are sometimes now being incorporated into mobile stations to determine the positioning information. GPS receivers are operable at a 1.5 GHz band. And a mobile station utilizing a GPS receiver would generally also have a GPS antenna transducer. A cellular mobile station operable in a single cellular network would therefore include an antenna transducer operable at a cellular frequency and an antenna transducer operable at a GPS frequency.

As mobile stations are constructed to be of increasingly miniaturized dimensions, the need increasingly to position the antenna transducers closer to one another causes problems. In particular, coupling between the antenna transducers causes destructive interaction between the antennas and lessens the gains of the antenna transducers.

Any manner by which to permit the antenna transducers to be positioned close to one another while also reducing the coupling therebetween would be advantageous.

It is in light of this background information related to radio communication systems that the significant improvements of the present invention have evolved.

SUMMARY OF THE INVENTION

The present invention, accordingly, advantageously provides an antenna transducer assembly, and an associated method, by which to transduce communication signals at a radio device, such as a mobile station operable in a cellular communication system.

Through operation of an embodiment of the present invention, a manner is provided by which to transduce communication signals generated at, or communicated to, a multi-mode, mobile station, or other radio device, capable of operation in at least two separate frequency bands.

An antenna transducer assembly of an embodiment of the present invention is of compact dimensions and exhibits reduced antenna transducer coupling relative to conventional antenna transducer assemblies. Because of the reduction in the antenna-transducer coupling, the gain characteristics of the antenna transducers of the assembly are improved. Improved radio operation of a mobile station that incorporates the antenna transducer assembly is thereby provided.

In one aspect of the present invention, an antenna transducer assembly is provided that includes two separate, spaced-apart antenna transducers disposed upon a common substrate. A first of the antenna transducers is of dimensions to transduce signals generated at a first range of frequencies, and a second of the antenna transducers is of dimensions to transduce signals within a second frequency band.

In another aspect of the present invention, the first and second antenna transducers are positioned to be spaced-apart from one another by selective separation distances, thereby to reduce the levels of coupling therebetween. The antenna transducers are formed of a conductive material painted, or otherwise disposed at, a substrate. The antenna transducers, when disposed at the substrate, are, if desired, formed upon separate surfaces of the substrate.

In another aspect of the present invention, the antenna transducers are of arcuate configurations that define concave edge surfaces along their respective lengths. The concave edge surfaces of the respective antenna transducers are positioned such that the concave edge surfaces of the respective antenna transducers face one another. Thereby, the separation distance separating at least portions of the antenna transducers are greater than if the antenna transducers were instead of linear configurations.

In yet a further aspect of the present invention, at least one of the arcuate-extending antenna transducers is serpentine-shaped to be of an S-shaped configuration. An end portion of the S-shaped antenna transducer is positioned such that a distal end portion of the second of the antenna transducers is positioned to be orthogonal to the end part of the S-shaped antenna transducer. Such relative positioning of the antenna transducers further facilitates reduced coupling between the antenna transducers. Because the antenna transducers are formed and positioned in manners to reduce coupling therebetween, the antenna transducers can be positioned more closely to one another than would otherwise conventionally be possible. Packaging of a mobile station in a reduced housing package is possible. And, the gain characteristics of the antenna transducers are improved relative to the gain characteristics permitted of antenna transducers positioned in close proximity to one another.

In one implementation, an antenna transducer assembly is provided for a cellular, mobile station that also includes a GPS receiver. A first antenna transducer is of lengthwise dimensions to facilitate transducing of signals generated during operation of the cellular communication system. The cellular communication system operates at, for instance, an 800 MHz frequency band or, for example, at a 1.9 GHz. The assembly also includes a second antenna transducer of lengthwise dimensions to facilitate transducing of signals generated at a 1.5 GHz frequency band. The antenna transducers of the assembly are positioned relative to one another to reduce coupling therebetween, thereby advantageously to increase the respective gains of the antenna transducers.

In these and other aspects, therefore, an antenna transducer assembly, and an associated method, is provided for a radio device. The radio device operates upon first radio signals communicated within a first frequency bandwidth and upon second radio signals communicated within a second frequency bandwidth. The antenna transducer assembly is disposed at a substrate, and the antenna transducer assembly transduces the first and second radio signals. A first antenna transducer portion is disposed at the substrate. The first antenna transducer portion transduces the first radio signals. The first antenna transducer portion is formed of a first elongated conductive member that defines a proximal side part and a distal side part. The distal side part has an edge face surface. The second antenna transducer portion is also disposed at the substrate. The second antenna transducer portion transduces the second radio signals. The second antenna transducer portion is spaced-apart from the first antenna transducer portion and is formed of a second elongated conductive member. The second elongated conductive member has a tipped distal end portion that is positioned orthogonal to the edge face surface of the distal side part of the first antenna transducer portion.

A more complete appreciation of the present invention and the scope thereof can be obtained from the accompanying drawings that are briefly summarized below, the following detailed description of the presently-preferred embodiments of the invention, and the appended claims.

DETAILED DESCRIPTION

Figure 1:
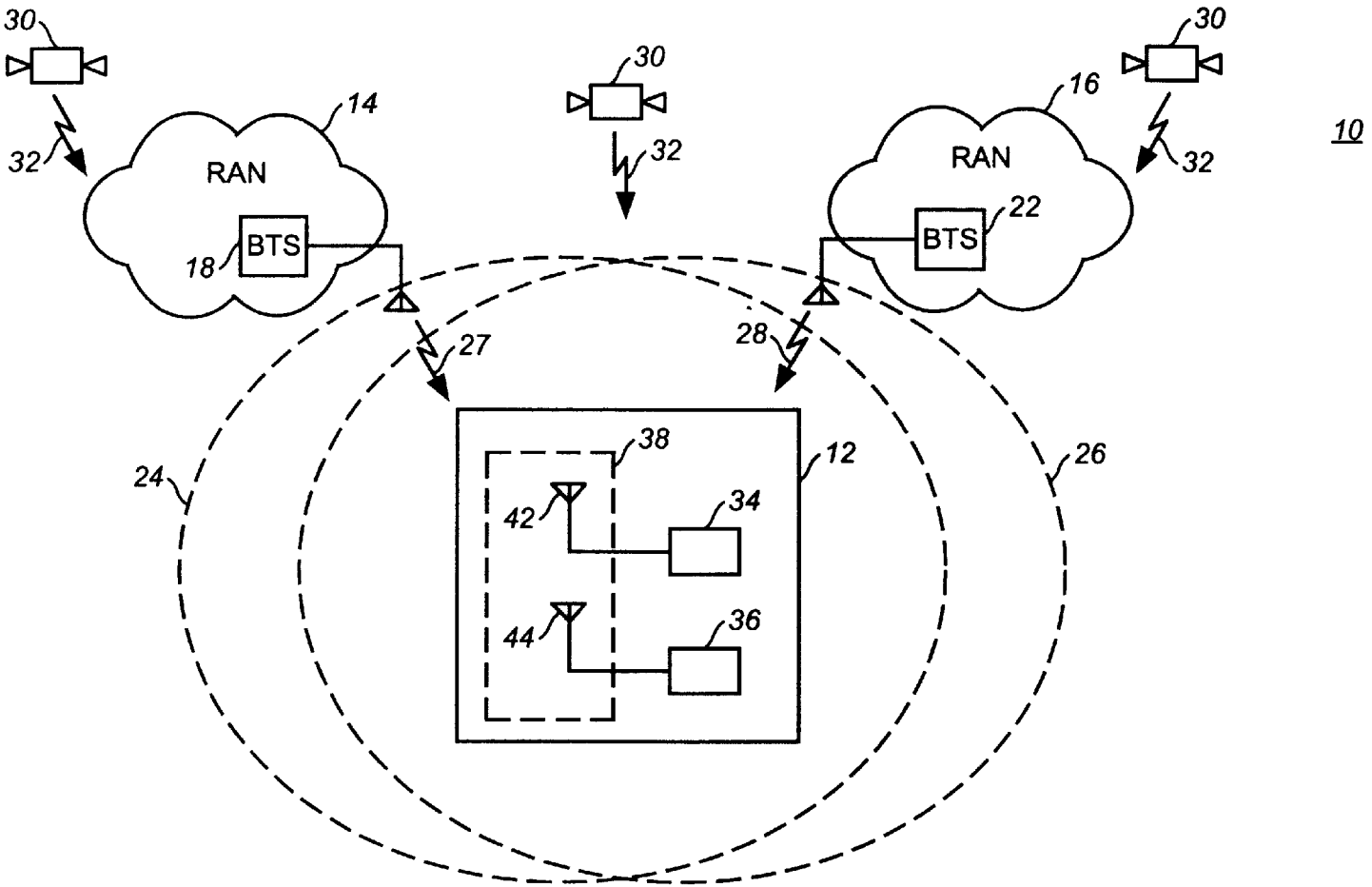
FIG. 1 illustrates a functional block diagram representative of a portion of a cellular communication system in which an embodiment of the present invention is operable.

Referring first to FIG. 1, a radio communication system, shown generally at 10, operates to provide for radio communications with mobile stations, of which the mobile station 12 is representative. The radio communication system 10 here forms a cellular communication system. While the present invention shall be described with respect to its implementation in a cellular communication system, an embodiment of the present invention is analogously also implementable to facilitate communications in other types of communication systems.

The cellular communication system 10 includes the network infrastructures of cellular communication networks operable at two separate frequency bands, such as the 800 MHz frequency band and at the 1.9 GHz frequency band. In the Figure, a first radio access network (RAN) 14 is representative of the first network infrastructure operable at the 800 MHz frequency band. And, a second radio access network (RAN) 16 is representative of the network infrastructure that operates the 1.9 GHz frequency. The radio access network 14 is shown to include a base transceiver station (BTS) 18, and the radio access network 16 is shown to include a base transceiver station (BTS) 22. The radio access networks, of course, include additional functional and physical entities, details of which are set forth in communication standards promulgated by an appropriate standards body, such as the EIA/TIA. The radio access network is constructed, for instance, to be operable pursuant to an AMPS (Advanced Mobile Phone Service) standard, and the radio access network 16 is constructed, for instance, to be operable pursuant to an IS-95 (Interim Standard-95) cellular communication standard.

The base transceiver station 18 defines a cell 24, and the base transceiver station 22 defines a cell 26. The cells 24 and 26 here encompass substantially-overlapping coverage areas.

Communications are effectuated between the respective base transceiver stations and the mobile station 12 by way of radio communication channels defined upon radio links 27 and 28, respectively. The mobile station here forms a dual-mode mobile station capable of operation to communicate with either of the radio access networks 14 or 16. More generally, the mobile station 12 is representative of any multi-mode radio transceiver capable of operation to communicate at separate frequency bands.

The communication system further includes a GPS (Global Positioning System) network having satellite-based, or other, positioning transmitters 30. The GPS transmitters generate signals on channels defined upon radio links 32. The signals generated by the transmitters 30, upon detection, are used for position-determining operations. The mobile station includes radio transceiver circuitry to effectuate such communications with either of the radio access networks. And, in the Figure, the radio transceiver circuitry is represented as a first radio transceiver part 34 operable to transceive communication signals with the first radio access network. A second radio transceiver part 36 is also shown in the Figure. The second radio transceiver part is operable at a second frequency. For example, the second radio transceiver part is operable to transceive radio communication signals with the second radio access network 16. Or, the second transceiver part is operable at GPS frequencies. While represented by separate elements in the Figure, in an actual implementation, portions of the radio transceiver parts might be formed of common elements.

The radio transceiver parts 34 and 36 are coupled to an antenna transducer assembly 38 of an embodiment of the present invention. The radio transducer assembly includes a first antenna transducer 42 and a second antenna transducer 44. The first antenna transducer 42 is coupled to the radio transceiver part 34 and operates to transduce radio signals at the 800 MHz frequency band at which the radio access network 14 operates. And, the second antenna transducer 44 is coupled to the radio transceiver part 36. The second antenna transducer operates to transduce radio signals at, e.g., the 1.9 GHz frequency band at which the radio access network 16 operates or at the 1.5 GHz frequency band at which the GPS operates. The radio transducer assembly is of compact dimensions facilitating miniaturization of the mobile station into a housing of reduced dimensional configuration.

Figure 2:
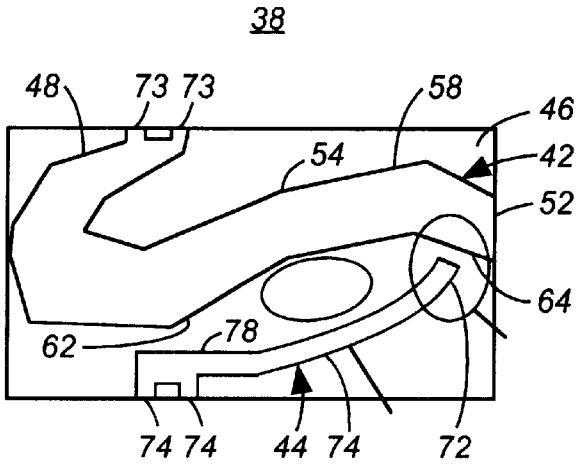
FIG. 2 illustrates a partial functional block, partial perspective view of the antenna transducer assembly of an embodiment of the present invention.

FIG. 2 illustrates the radio transducer assembly 38 that forms a part of the mobile station 12 pursuant to an embodiment of the present invention. The first and second antenna transducers 42 and 44 are again shown to form portions of the radio transducer assembly. Both of the antenna transducers are formed of conductive material disposed upon, or within, a substrate, such as a printed wire board (PWB). The lengthwise dimensions of the respective antenna transducers are selected responsive to the frequencies of the radio signals that the antenna transducers are intended to transduce.

The first antenna transducer 42 defines a proximal end side 48 and a distal end side 52. And, the antenna transducer further defines an elongated arcuate central section 54 defining a convex edge surface 58 and a concave edge surface 62. The concave edge surface extends to, and includes, at the distal side end portion 52 an edge face surface 64. In the exemplary implementation, the proximal and distal end portions 48 and 52 and the arcuate-extending central section 54 together define the antenna transducer to be serpentine-shaped.

The second antenna transducer 44 is also elongated in configuration and defines a proximal end side 68 and a distal end side 72. An arcuate-extending, central portion 74 defines a convex edge surface 76 and a concave edge surface 78. The antenna transducers are formed, relative to one another, such that the concave edge surfaces 62 and 78 of the respective antenna transducers face one another.

The distal side end part 74 of the second antenna transducer 44 further extends in a direction that is orthogonal to the edge face surface 64 of the first antenna transducer. Due to the orthogonality of the relationship between the distal end side part 72 and the edge face surface 64, the coupling between the antenna transducers is reduced. Because of the reduced coupling, the gains associated with the antenna transducers are increased and, for a given gain, the antenna transducers are able to be positioned more proximate to one another than otherwise would be permitted.

The distal end parts 48 and 68 of the respective antenna transducers also include connecting elements, or blocks, 72 and 74, respectively, to facilitate connection of the respective antenna transducers with radio transceiver parts 34 and 36 (shown in FIG. 1).

Figure 3:
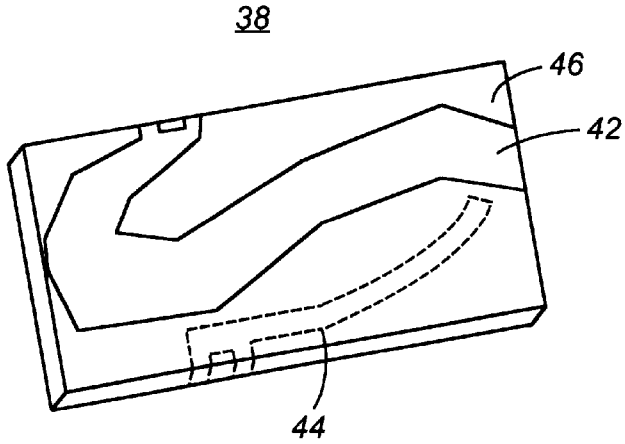
FIG. 3 illustrates another partial functional block, partial perspective view, of the antenna transducer assembly of another embodiment of the present invention.

FIG. 3 also illustrates a radio transducer assembly 38 of an embodiment of the present invention. Again, the antenna transducers 42 and 44 are disposed upon a substrate 46. In the implementation shown in the Figure, the first antenna transducer is disposed upon a top face surface 78 of the substrate. And, the second antenna transducer 44 is disposed upon a bottom face surface 82 of the substrate.

Figure 4:
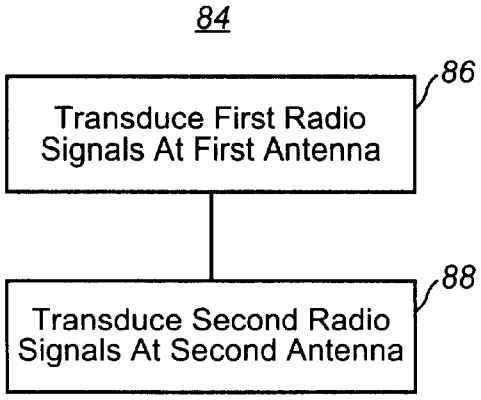
FIG. 4 illustrates a method flow diagram listing the method of operation of an embodiment of the present invention.

FIG. 4 illustrates a method flow diagram, shown generally at 84, of an embodiment of the present invention. The method operates to permit first and second radio signals, generated during operation of a radio device between electromagnetic and electrical form. The first radio signals are generated within a first frequency bandwidth. And, the second radio signals are communicated within a second frequency bandwidth.

First, and as indicated by the block 86, the first radio signals are selectably transduced at a first antenna transducer positioned at a substrate. The first antenna transducer is formed of a first elongated conductive member defining a proximal side part and a distal side part. The distal side part has an edge face surface.

And, the second radio signals are selectably transduced at a second antenna transducer. The second antenna transducer is also positioned at the substrate. The second antenna transducer is spaced-apart from the first antenna transducer. The second antenna transducer is formed of a second elongated conductive member having a tipped distal end portion positioned orthogonal to the edge face surface of the distal side part of the first antenna transducer.

Thereby, a manner is provided by which to transduce radio signals generated at separate frequency bands at a radio transducer assembly that is of compact dimensions. Reduced coupling between the antenna transducers, and their corresponding improved gain characteristics facilitates the use of the antenna transducer assembly in a mobile station of reduced dimensional configuration.

The previous descriptions are of preferred examples for implementing the invention, and the scope of the invention should not necessarily be limited by this description. The scope of the present invention is defined by the following claims.

What is claimed is:

1. In a radio device that operates upon first radio signals communicated within a first frequency bandwidth and second radio signals communicated within a second frequency bandwidth, an improvement of an antenna transducer assembly disposed at a substrate, said antenna transducer assembly for transducing the first and second radio signals, said antenna transducer assembly comprising:

a first antenna transducer portion disposed at the substrate, said first antenna transducer portion for transducing the first radio signals, said first antenna transducer portion formed of a first elongated conductive member defining a proximal side part and a distal side part, the distal side part having an edge face surface, the first elongated conductive member forming said first antenna transducer portion further defines a first arcuate-extending section having a concave side surface extending to, and at least partly-including, the edge face surface of the distal side part of the first elongated conductive member; and a second antenna transducer portion also disposed at the substrate, said second antenna transducer portion for transducing the second radio signals, said second antenna transducer portion spaced-apart from said first antenna transducer portion and formed of a second elongated conductive member, the second elongated conductive member having a tipped distal end portion position orthogonal to the edge face surface of the distal side part of said first antenna transducer portion, the second elongated member forming said second antenna transducer portion further defines a second arcuate-extending section, the second arcuate-extending section also having a concave side surface, the concave side surface of said first antenna transducer portion positioned to face the concave side surface of said second antenna transducer portion.

2. The antenna transducer assembly of claim 1 wherein the substrate defines a top face surface and a bottom face surface and wherein said first antenna transducer portion disposed at the substrate is disposed at the top face surface of the substrate.

3. The antenna transducer assembly of claim 2 wherein said second antenna transducer portion is disposed at the bottom face surface of the substrate.

4. The antenna transducer assembly of claim 1 wherein the first arcuate-extending section defined by the first elongated conductive member forming said first antenna transducer portion is of a first selected amount of curvature.

5. The antenna transducer assembly or claim 4 wherein the second arcuate-extending section defined by the second elongated conductive member forming said second antenna transducer portion is of a second selected amount of curvature, the first and second selected amounts of curvature, respectively, at least in part defining levels of coupling between said first and second antenna transducer portions.

6. The antenna transducer assembly of claim 5 wherein the second arcuate-extending section defined by the second elongated conductive member of said second antenna transducer portion extends to, and at least partly includes, the distal end portion thereof.

7. The antenna transducer assembly of claim 6 wherein the second arcuate-extending section defined by the second elongated conductive member formed of said second antenna transducer portion is of a serpentine shape.

8. The antenna transducer assembly of claim 7 wherein the first arcuate-extending section defined by the second elongated conductive member formed of said first antenna transducer portion is of a serpentine shape.

9. The antenna transducer assembly of claim 8 wherein the radio device comprises a first radio circuit portion and wherein the proximal side part of the first elongated conductive member further comprise connector parts connectable to the first radio part.

10. The antenna transducer assembly of claim 9 wherein the radio device further comprises a second radio circuit portion and wherein the second elongated conductive member further comprise connector ports connectable to the second radio port.

11. The antenna transducer assembly of claim 10 wherein the fast frequency bandwidth encompasses a cellular-frequency band and wherein the first radio signals that said first antenna transducer portion transduces are within the cellular-frequency band.

12. The antenna transducer assembly of claim 11 wherein the second frequency bandwidth encompasses a frequency band greater in frequency than the cellular frequency band and wherein the second radio signals that said second antenna transducer portion transduces are within the frequency band greater than the cellular frequency band.

13. The antenna transducer assembly of claim 1 wherein the radio device comprises a mobile station, wherein the first frequency bandwidth comprises a cellular-band and wherein the second frequency bandwidth comprises a PCS (Personal Communication Service) band.

14. In a method for communicating at a radio device that operates upon first radio signals communicated within a first frequency bandwidth and second radio signals communicated within a second frequency bandwidth, an improvement of a method for transducing the first and second radio signals, said method comprising:

selectably transducing the first radio signals at a first antenna transducer positioned at a substrate, the first antenna transducer formed of a first elongated conductive member defining a proximal side part and a distal side part, the distal side part having an edge face surface;

selectably transducing the second radio signals at a second antenna transducer also positioned at the substrate and spaced-apart from the first antenna transducer, the second antenna transducer formed of a second elongated conductive member having a tipped distal end portion positioned orthogonal to the edge face surface of the distal side part of the first antenna transducers;

selecting a separation distance by which to space-apart the first antenna transducer and the second antenna transducer; and positioning the first antenna transducer and the second antenna transducer on the substrate at the separation distance selected during said operation of selecting, wherein the substrate defines a top face surface and a bottom face surface and wherein said operation of positioning comprises positioning the first antenna transducer at the top face surface and the second antenna transducer at the bottom face surface; the first antenna transducer further defines a first arcuate-extending section having a concave side surface, the second antenna transducer further defines a second arcuate-extending section having a concave side surface, and wherein said operation of positioning comprises positioning the concave side surfaces of the first and second antenna transducers, respectively, to face each other.

15. The method of claim 14 wherein the first arcuate-extending section is of a first selected amount of curvature, wherein the second arcuate-extending section is of a second selected amount of curvature and wherein said method further comprises the initial operation of selecting the first and second selected amounts, respectively, of the curvature.

16. The method of claim 15 wherein the radio device comprises a mobile station, wherein the first frequency bandwidth comprises a cellular-band and wherein the second frequency bandwidth comprises a PCS (Personal Communication Service) band.

17. An antenna transducer assembly for a radio device that operates upon first radio signals communicated within a first frequency bandwidth comprises a cellular-band and wherein the second frequency bandwidth, disposed at a substrate, said antenna transducer transducing the first and second radio signals, said antenna transducer assembly comprising:

a first antenna transducer portion disposed at the substrate, said first antenna transducer portion for transducing the first radio signal, said first antenna transducer portion formed of a first elongated conductive member defining a proximal side part and a distal side part, the distal side part having an edge face surface, the first elongated conductive member forming said first antenna transducer portion further defines a first arcuate-extending section having a concave side surface extending to, and at least partly-including, the edge face surface of the distal side part of the first elongated conductive member; and a second antenna transducer portion also disposed at the substrate, said second antenna transducer portion for transducing the second radio signals, said second antenna transducer portion spaced-apart from said first antenna transducer portion and formed of a second elongated conductive member, the second elongated conductive member having a tipped distal and portion positioned orthogonal to the edge face surface of the distal side part of said first antenna transducer portion, the second elongated member forming said second antenna transducer portion further defines a second arcuate-extending section, the second arcuate-extending section also having a concave side surface, the concave side surface of said first antenna transducer portion positioned to face the concave side surface of said second antenna transducer portion.

18. The antenna transducer assembly of claim 17 wherein the radio device comprises a mobile station, wherein the first frequency bandwidth comprises a cellular-band and wherein the second frequency bandwidth comprises a PCS (Personal Communication Service) band.

* * * * *